US010897938B2

(12) United States Patent
Davenport et al.

(10) Patent No.: US 10,897,938 B2
(45) Date of Patent: Jan. 26, 2021

(54) WEARABLE DEVICE FOR FALL INJURY MITIGATION

(71) Applicant: Davenport Saf-T Systems LLC, Minneapolis, MN (US)

(72) Inventors: Jay A. Davenport, Mountain Iron, MN (US); Nathan Max, Lakeville, MN (US)

(73) Assignee: DAVENPORT SAF-T SYSTEMS LLC, Minneapolis, MN (US)

( * ) Notice: Subject to any disclaimer, the term of this patent is extended or adjusted under 35 U.S.C. 154(b) by 352 days.

(21) Appl. No.: 15/418,310

(22) Filed: Jan. 27, 2017

(65) Prior Publication Data

US 2017/0208874 A1 Jul. 27, 2017

Related U.S. Application Data

(60) Provisional application No. 62/287,844, filed on Jan. 27, 2016.

(51) Int. Cl.
*A41D 13/05* (2006.01)
*A41D 1/00* (2018.01)
(Continued)

(52) U.S. Cl.
CPC ..... *A41D 13/018* (2013.01); *A41D 1/002* (2013.01); *A41D 13/0512* (2013.01);
(Continued)

(58) Field of Classification Search
CPC .... A41D 13/018; A41D 1/04; A41D 13/0125; B63C 9/08; B63C 9/125; B63C 9/1255; B63C 9/155
(Continued)

(56) References Cited

U.S. PATENT DOCUMENTS 5,091,992 A * 3/1992 Pusic ..... A41D 13/018 2/16
5,313,670 A * 5/1994 Archer, III ..... A41D 13/018 2/410
(Continued)

FOREIGN PATENT DOCUMENTS

EP 2804788 A1 11/2014
EP 2956026 A2 12/2015
WO 2011148350 A1 12/2011

OTHER PUBLICATIONS

Hit-Air Shock Buffering System, website <https://air-vest.com/>, visited Apr. 2, 2019, 5 pages.
(Continued)

*Primary Examiner* — Jillian K Pierorazio
(74) *Attorney, Agent, or Firm* — Kinney & Lange, P.A.

(57) ABSTRACT

An inflatable garment designed to reduce the severity of fall-related injuries is disclosed. The garment includes at least one inflatable chamber, an upper portion, a middle portion, and a lower portion. The garment also includes an inflation mechanism in fluid communication with the at least one inflatable chamber, a sensor network configured to detect a plurality of physical parameters indicative of a fall, and a logic circuit configured to process the plurality of physical parameters, and to trigger the inflation mechanism when each of the plurality of physical parameters surpasses a threshold value. Each of the upper, middle, and lower portions are configured to inflate in an anterior, posterior, and lateral direction via the at least one inflatable chamber. The garment is further configured to deflate to prevent contrecoup injuries.

18 Claims, 9 Drawing Sheets

(51) Int. Cl.
*A41D 13/018* (2006.01)
*G08B 21/04* (2006.01)

(52) U.S. Cl.
CPC ..... *A41D 13/0525* (2013.01); *G08B 21/043* (2013.01); *G08B 21/0446* (2013.01)

(58) Field of Classification Search
USPC ..... 2/455; 280/730.1; 441/106, 108, 111
See application file for complete search history.

(56) References Cited

U.S. PATENT DOCUMENTS 5,362,098 A * 11/1994 Guill ..... A41D 13/018 2/456
5,402,535 A * 4/1995 Green ..... A41D 13/018 128/DIG. 23
5,535,446 A * 7/1996 Pusic ..... A42B 3/0486 2/456
5,546,602 A 8/1996 Hale
5,946,729 A 9/1999 Sakurai et al.
6,125,478 A 10/2000 Alaloof
6,230,333 B1 * 5/2001 Umeda ..... A41D 13/0125 2/463
6,433,691 B1 8/2002 Hilliard et al.
6,859,939 B1 * 3/2005 Osburn, Sr. ..... A41D 13/018 128/869
6,997,218 B1 2/2006 Garcia et al.
7,150,048 B2 12/2006 Buckman
7,343,632 B2 3/2008 Neron
7,392,549 B1 7/2008 Barber
9,027,170 B2 * 5/2015 Dainese ..... A41D 13/018 2/455
2004/0111790 A1 * 6/2004 Dainese ..... A41D 13/018 2/456
2005/0067816 A1 * 3/2005 Buckman ..... A41D 13/018 280/730.1
2005/0279559 A1 12/2005 Thevenot
2006/0267779 A1 * 11/2006 Ishikawa ..... A43B 7/32 340/573.1
2006/0288464 A1 * 12/2006 Warden ..... A41D 13/018 2/69
2010/0004567 A1 * 1/2010 Ishikawa ..... A61B 5/6807 600/595
2011/0047684 A1 * 3/2011 Jan ..... A41D 13/018 2/455
2011/0237194 A1 * 9/2011 Kojima ..... A41D 13/018 455/41.3
2014/0047623 A1 * 2/2014 Richards ..... A41D 13/018 2/455
2014/0352042 A1 * 12/2014 Celi ..... A41D 13/0155 2/455
2015/0044922 A1 * 2/2015 Flythe, Jr. ..... B63C 9/1255 441/106
2016/0073707 A1 * 3/2016 Ronco ..... A41D 1/04 2/462
2016/0174626 A1 6/2016 Mazzarolo et al.

OTHER PUBLICATIONS

Hip-Hope™ Smart Wearable Hip Protector Using Cutting-edge Technology and Design, website <https://www.hip-hope.com/>, visited Apr. 2, 2019, 5 pages.

* cited by examiner

WEARABLE DEVICE FOR FALL INJURY MITIGATION

BACKGROUND

The present invention relates to fall injury mitigation, and more particularly to a wearable apparatus and associated method for fall injury mitigation.

Every year thousands of people—often the elderly and the disabled—fall resulting in life-changing consequences ranging from hip fracture to spinal injuries. In 1790 in America, people 65 and older made up less than 2% of the population, while today 15% of the population in the United States is 65 or older. In Italy, Germany, and Japan the figure is 20%. In much of the world the life expectancy is 80+ years and as we age our physical condition becomes gradually more compromised despite modern medicine and best intentions. The single most important factor that allows the aged to be independent and to remain in their home is the ability to ambulate. Activities of daily living, bathing, meal preparation, dressing, using the bathroom, can only rarely be done by the aged individual at a wheelchair level unassisted. Each year nearly 350,000 Americans fall and break their hip (or break their hip and fall). Of those, 40% end up in a nursing home and 20% can never walk again. Falls account for 20% of hospital visits by seniors and 40% of nursing home admissions, according to The Centers For Disease Control and Prevention, and are the leading cause for injury in people 65 or older and also the leading cause of brain injury. Falls can lead to disabling injuries, and even death. The three primary risk factors for falling are poor balance, muscle weakness, and taking four or more prescription drugs. In a single year, elderly people without risk factors have a 12% chance for falling and with all three risk factors a 100% chance of falling.

Hospitals have spent considerable time and resources addressing the problem of injury from falls—increasing the use of alarms and motion sensors to alert staff that a weakened patient moves—and purchasing adjustable beds and other protective gear. However, these warning systems essentially limit ambulation, but provide no protective benefit while a patient ambulates. Physical therapy can restore strength and balance so that independence is feasible in the debilitated patient but risks of injury from falls remains so long as patients desire to be independent.

Therefore, there exists a need for a device or method that reduces the severity of injury from a fall, allowing patients, including those exhibiting factors that put them at risk of falling, to remain independent and in control of their own lives.

SUMMARY

An inflatable garment includes: at least one inflatable chamber, an upper portion, a middle portion, and a lower portion. The garment further includes: an inflation mechanism in fluid communication with the at least one inflatable chamber, a sensor network configured to detect a plurality of physical parameters indicative of a fall, and a logic circuit configured to process the plurality of physical parameters, and to trigger the inflation mechanism when each of the plurality of physical parameters surpasses a threshold value. Each of the upper, middle, and lower portions are configured to inflate in an anterior, posterior, and lateral direction via the at least one inflatable chamber. The upper and lower portions are configured to inflate a first length from a wearer's torso in the anterior, posterior, and lateral directions. The middle portion is configured to inflate a second length from the wearer's torso in the anterior direction, the second length being greater than the first length.

A method of operating an inflatable garment to protect a wearer from an impact, includes: providing an inflatable garment comprising at least one inflatable chamber, configuring an inflation mechanism to be in fluid communication with the at least one inflatable chamber, sensing, using a sensor network, a plurality of physical parameters indicative of a fall, and processing, using a logic circuit, the plurality of physical parameters. The method further includes: triggering, using the logic circuit, the inflation mechanism when each of the plurality of physical parameters surpasses a threshold value, inflating the at least one inflatable chamber using the inflation mechanism, and deflating the inflatable chamber.

DETAILED DESCRIPTION

In general, a wearable device is described herein that can be embodied as a lightweight, comfortable and non-obtrusive garment that includes a sensor network that is designed to deploy (e.g., pneumatically inflate) the garment such that it can absorb the physical impact of a fall. Further, the garment can include a fluidic bag that can deflate following the fall, and a distress signal can optionally be emitted to summon help. Such a device will serve those people who, due to age, medical condition or other reasons, are at an increased risk of falling. Numerous additional features and benefits will be appreciated in view of the entirety of the present disclosure, including the accompanying figures.

Biomechanics of a Fall

Figure 1A:
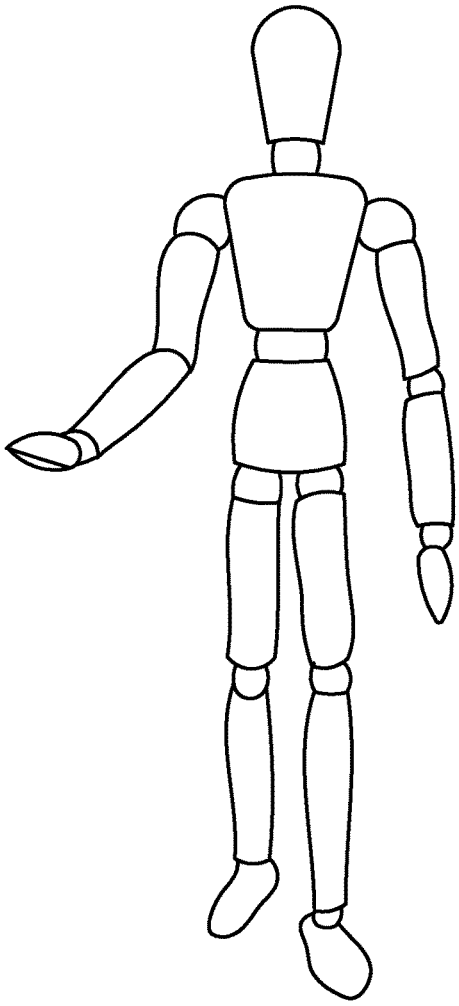
FIGS. 1A-1K are views of a patient alone in various positions.
Figure 1B:
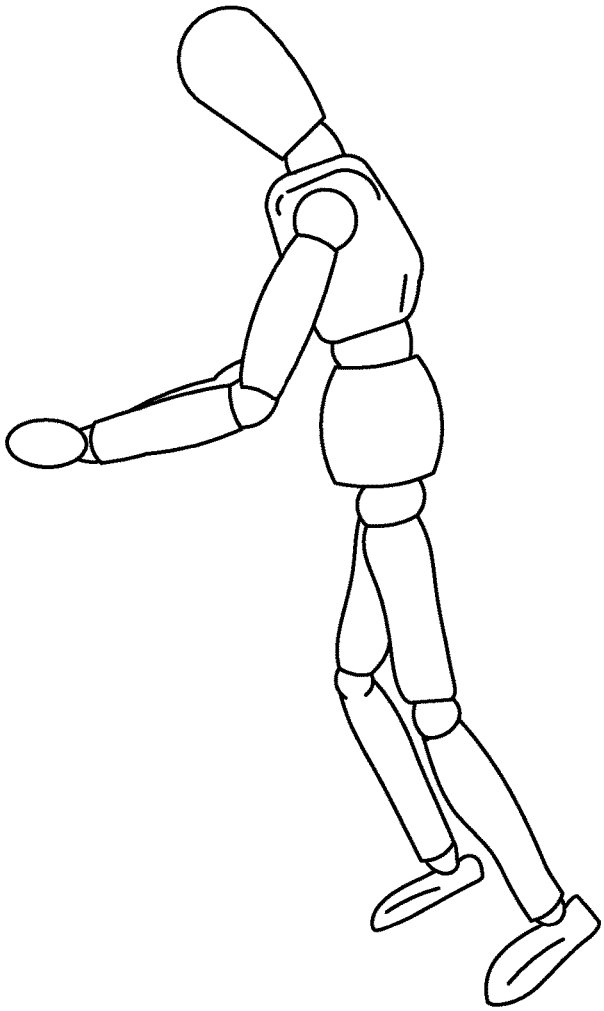
Figure 1C:
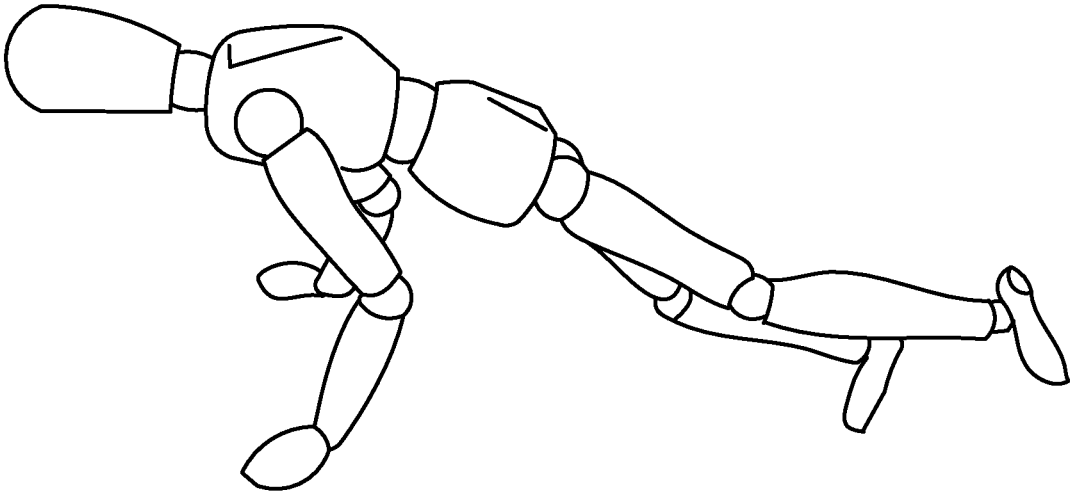
Figure 1D:
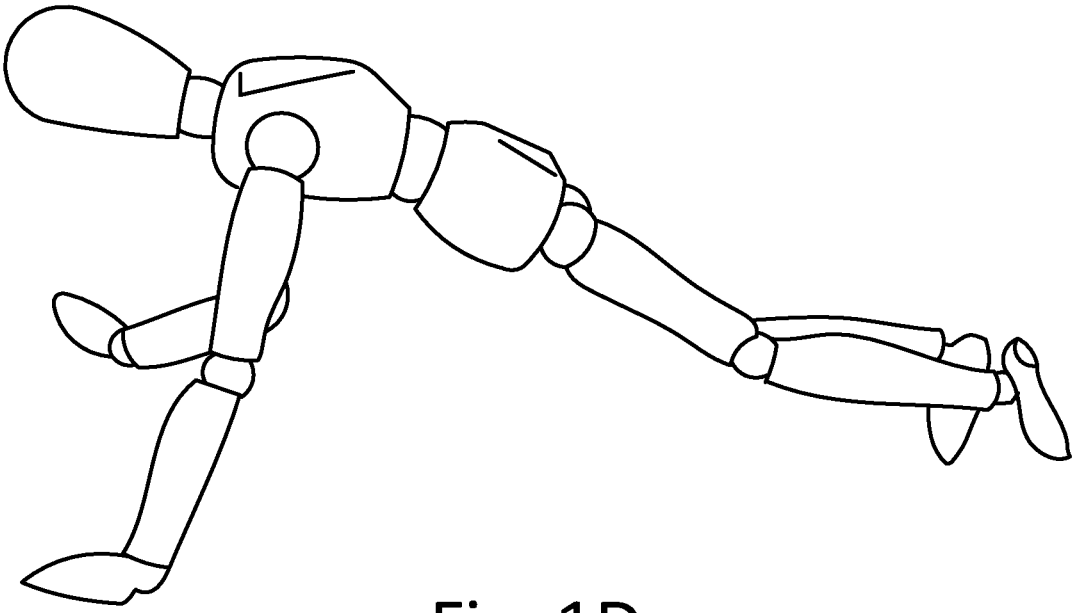
Figure 1E:
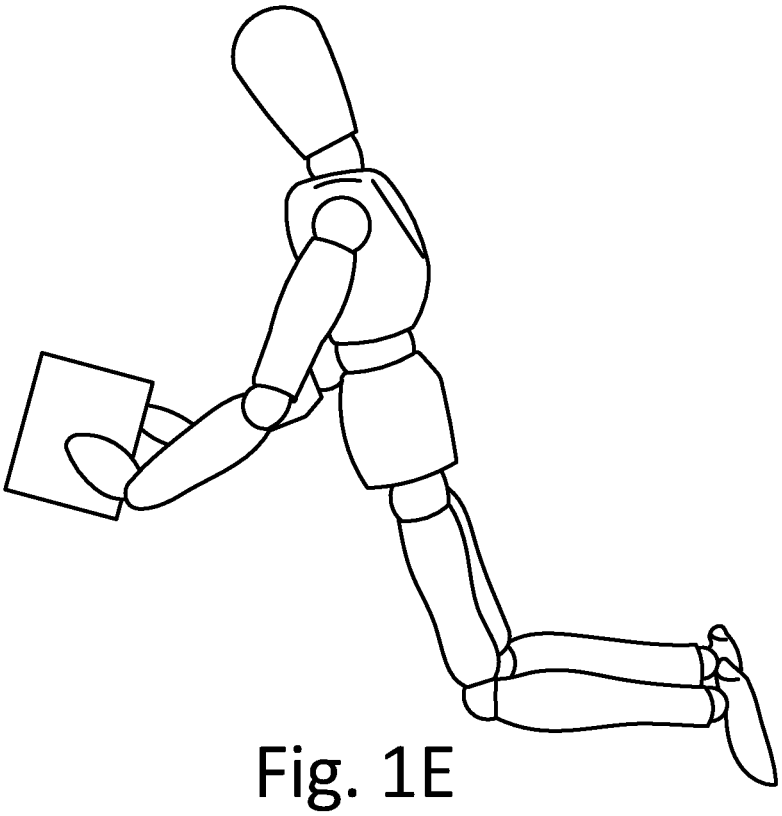
Figure 1F:
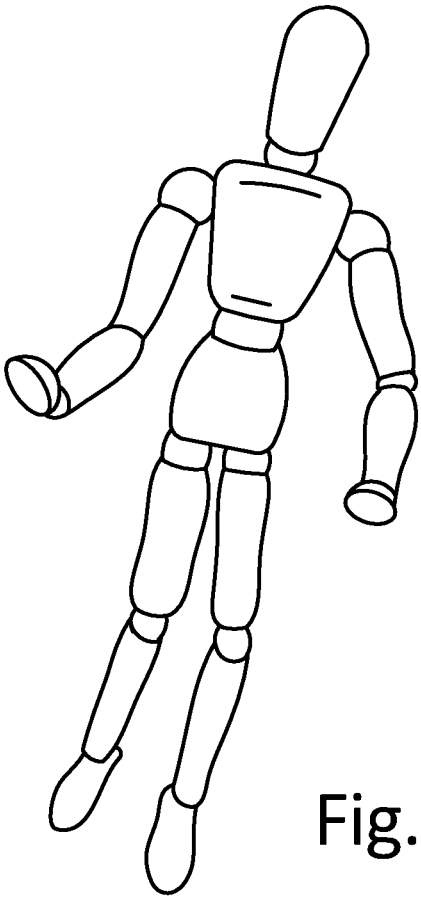
Figure 1G:
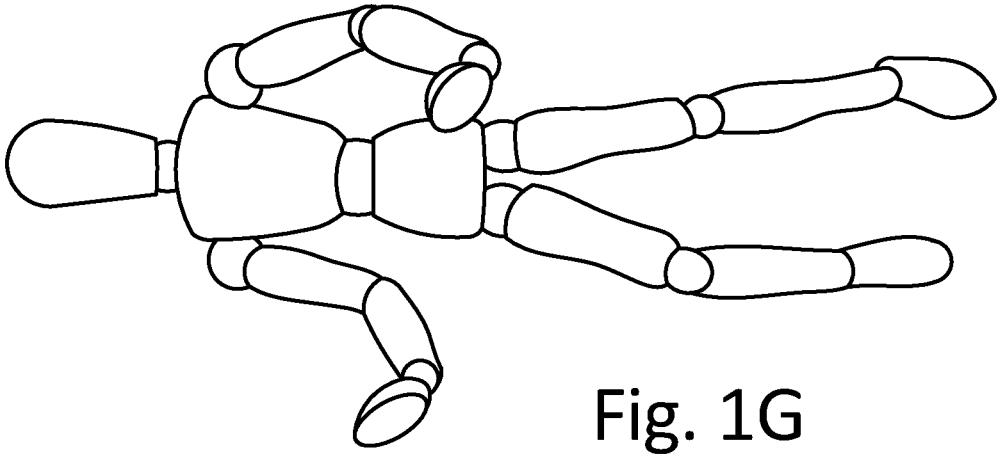
Figure 1H:
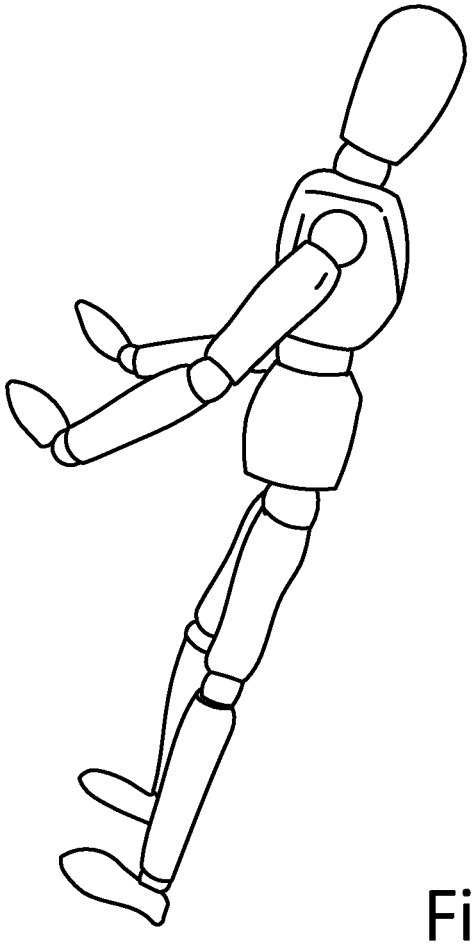
Figure 1I:
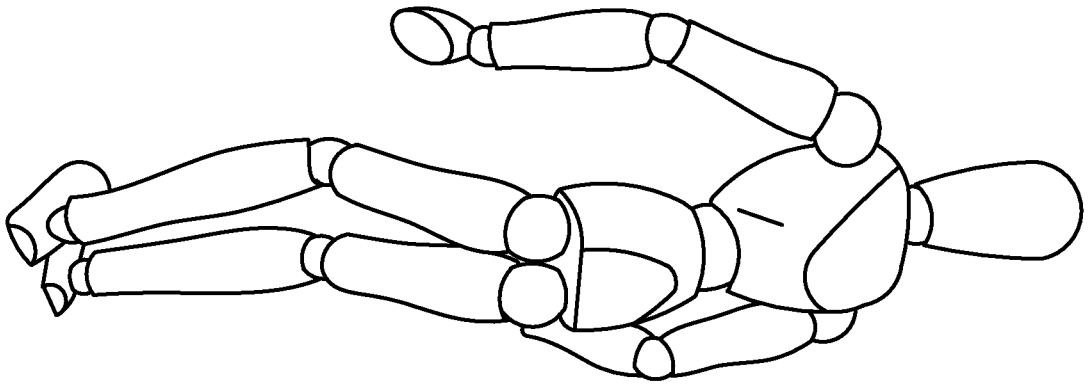
Figure 1J:
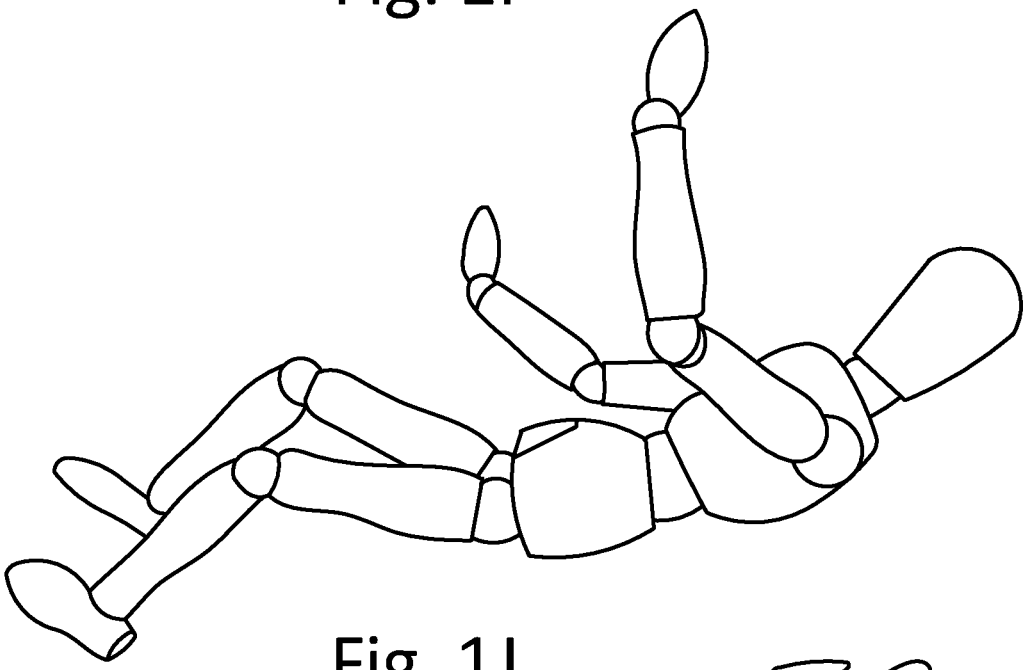
Figure 1K:
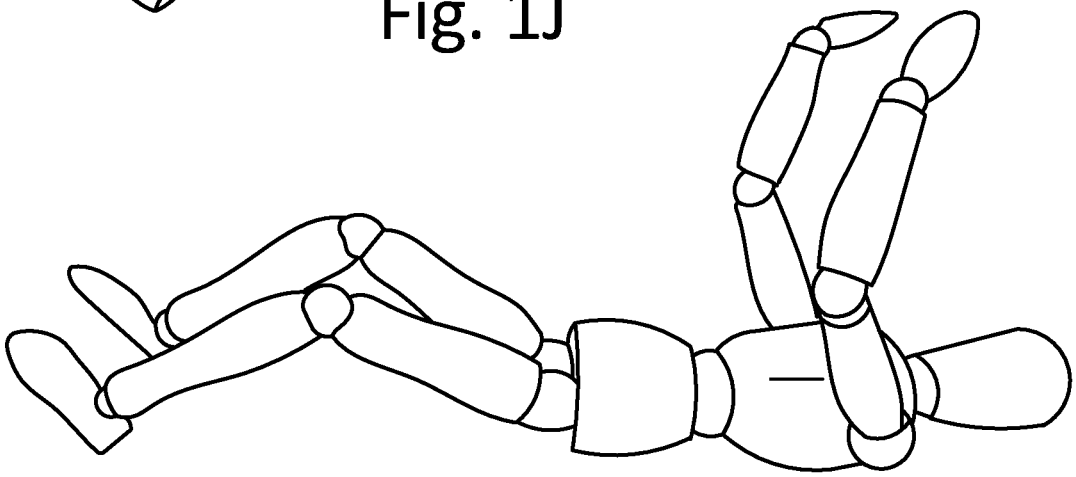

The following describes human biomechanics as they relate to falls. As long as the center of gravity remains over the single or double base of support, stable gait can occur (FIG. 1A), barring loss of consciousness or muscle failure. If the center of gravity falls outside the base of support, the subject must fall. If the center of gravity falls anterior to the base of support (FIG. 1B), the subject will fall in a frontal direction and will automatically (i.e., instinctually) thrust his or her arms in a forward direction, and will most likely impact the walking surface with one hand. If the elbow is flexed, a Colles type fracture of the wrist may occur (FIG. 1C), and if the elbow is in extension, the impact force will travel through the forearm and may also fracture the elbow and the shoulder (FIG. 1D). Direct impact may occur to the bent knees, particularly if the arms are carrying something, and fracture to the patella or femur may occur (FIG. 1E). If the center of gravity falls laterally to the base of support (FIG. 1F) and the arm and hand cannot break the fall, the force can be directed to the shoulder, resulting in comminuted fracture of the humerus (FIG. 1G). Depending on how the forces of the fall are transmitted, the hip may take most of the impact, resulting in a trochanteric hip fracture. When the center of gravity falls posterior to the base of support (FIG. 1H), the subject will fall backwards and may try to reach behind with his or her hand, resulting in wrist injury, or may strike one or both elbows, causing fractures (FIG. 1I). If there is no attempt to break the fall with the arms, the impact could contuse or fracture the coccyx (FIG. 1J) with high velocity impact to the spine and the posterior skull (FIG. 1K).

Various Features of the Device

Figure 2A:
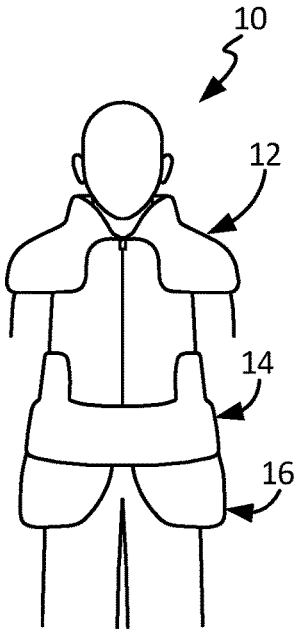
FIGS. 2A-2C are front, back, and side elevation views, respectively, of a device according to an embodiment of the present invention, shown with an outer shell removed and in the deflated state (i.e., not deployed).
Figure 2B:
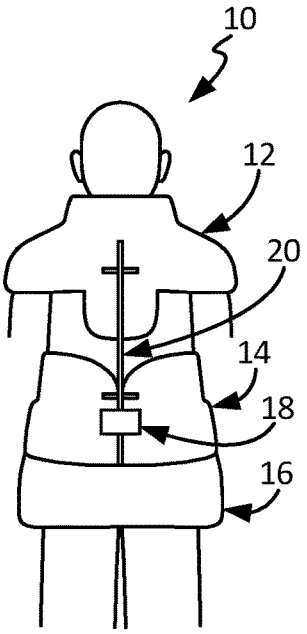
Figure 2C:
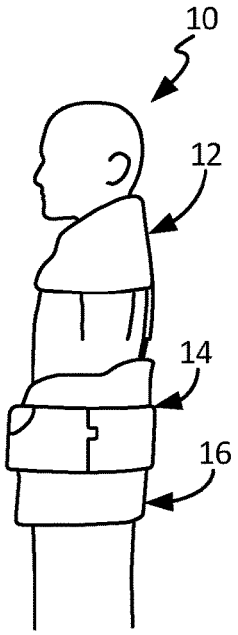
Figure 3A:
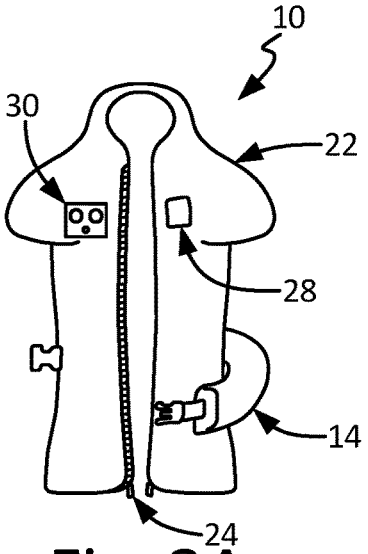
FIGS. 3A-3C are front, back, and side elevation views, respectively, of the device of FIGS. 2A-2C shown with the outer shell in place.
Figure 3B:
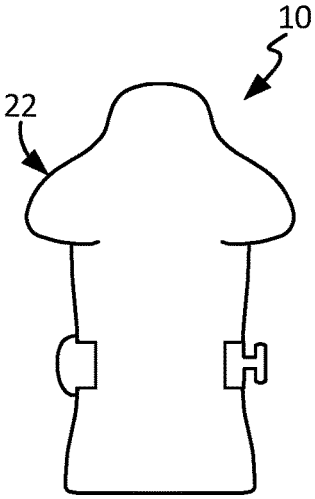
Figure 3C:
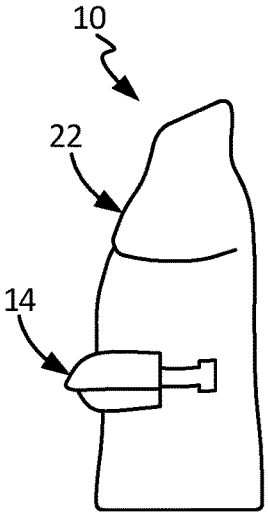

FIGS. 2A-2C show garment 10 in an uninflated state without its outer shell (which is shown in FIGS. 3A-3C). Garment 10 includes upper portion 12, middle portion 14, and lower portion 16. As can be seen in FIGS. 2A-2C, upper portion 12 is disposed over the wearer's neck and shoulders. Middle portion 14 is generally disposed around the wearer's waist or midsection, and lower portion 16 is disposed around the wearer's pelvic region.

FIG. 2B shows inflation mechanism 18 situated on a posterior side of garment 10. Inflation mechanism 18 is in fluid communication with the inflatable components of garment 10, for example, through supply lines 20. In some embodiments, garment 10 comprises a single inflatable chamber, such that portions 12, 14, and 16 are in fluid communication with one another, and can inflate in unison. In other embodiments, garment 10 can include a plurality of inflatable chambers. For example, any portion 12, 14, and 16 can include a separate inflatable chamber. In such an embodiment, each individual portion 12, 14, and 16 can be configured to be independently inflatable, or to inflate in unison. The inflatable chamber(s) of garment 10 can include a bag made of nylon, or any other suitable, resilient material.

Inflation mechanism 18 includes a chemical propellant inflator. Inflation mechanism 18 employs a sodium azide ($NaN_3$) based reaction to generate nitrogen gas ($N_2$) and solid sodium (Na). Inflation mechanism 18 further includes potassium nitrate ($KNO_3$) and silicon dioxide ($SiO_2$) that reacts with the sodium to form an alkaline silicate (glass) byproduct. The nitrogen gas inflates the inflatable chamber (s) within garment 10. In other embodiments, other chemical propellants can be used, as well as other methods of inflation. For example, inflation mechanism 18 can include a compressed gas system using $CO_2$, or any other suitable fluidic system. Although inflation mechanism 18 is shown mounted on the posterior side of garment 10, it can be mounted in other locations within garment 10. In some embodiments, garment 10 can include a plurality of inflation mechanisms 18.

FIGS. 3A-3C show garment 10 with outer shell 22. Outer shell 22 includes a midline fastener 24 used to secure garment 10 to the wearer's body. Fastener 24 can be a zipper, buttons, a hook-and-loop fastening system, or any other suitable fastener. It should be noted that the wearer does not have to use fastener 24 in order for garment 10 to function properly. Outer shell 22 is made of a deformable material such that it can expand when the inflatable chamber of garment 10 is inflated.

Garment 10 includes power source 26 (shown in FIG. 5) mounted interiorly to outer shell 22. In the embodiment shown, power source 26 is a pair of standard watch batteries. However, other types of batteries or power sources can be used. For convenience, the batteries of power source 26 can be rechargeable. Power source 26 powers the functional components of garment 10 (also shown in FIG. 5). Power source can be contained in a separate, accessible compartment, secured with a zipper, button, or some other suitable fastener. In other embodiments, power source 26 can be placed at other locations within garment 10, with or without its own compartment.

Garment 10 further includes signal light 28 mounted to outer shell 22. Signal light 28 can be a standard LED light, and can change colors to indicate the status of garment 10. For example, when power source 26 is low, signal light 28 can turn red in order to alert the wearer to recharge or replace power source 26. The red light can also be accompanied by a series of audible chirps to help alert the wearer, much like a household smoke detector. Signal light 28 can also alert the wearer to the operative status of garment 10, which will be explained more in detail below. For example, signal light 28 can turn green when garment 10 active and deployable, and white when garment 10 is inactive.

Also mounted to outer shell 22 is sensor network 30. Sensor network 30 includes gyroscope 32, accelerometer 34, and thermal sensor 36 (shown and described in FIG. 5). Sensor network 30 allows garment 10 to differentiate between normal wearer movements such as standing, sitting, and the swaying of the trunk associated with walking, from the out of control motion of falling, to reduce or avoid a risk of false deployment. When worn in bed, sensor network 30 can be configured to detect a different activity level, and be reactivated by sitting up to stand and walk. Although sensor network 30 is shown mounted to outer shell 22, it can be mounted anywhere within garment 10.

Figure 4C:
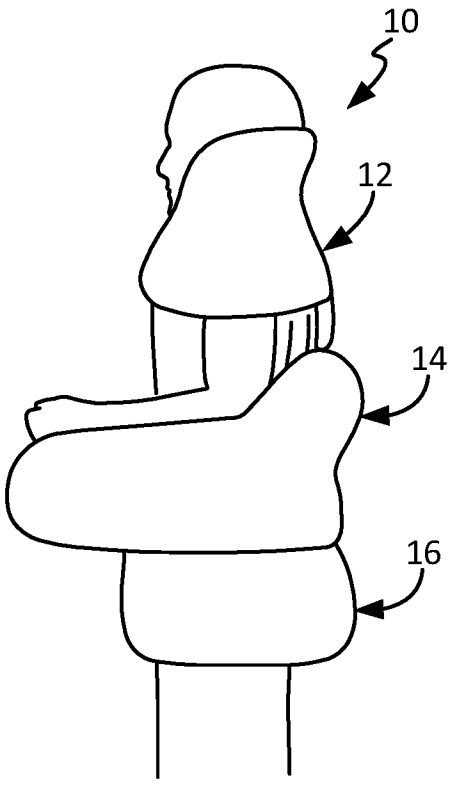
FIGS. 4A-4C are front, back, and side elevation views, respectively, of the device of FIGS. 2A-2C shown in the inflated state (deployed).
Figure 4B:
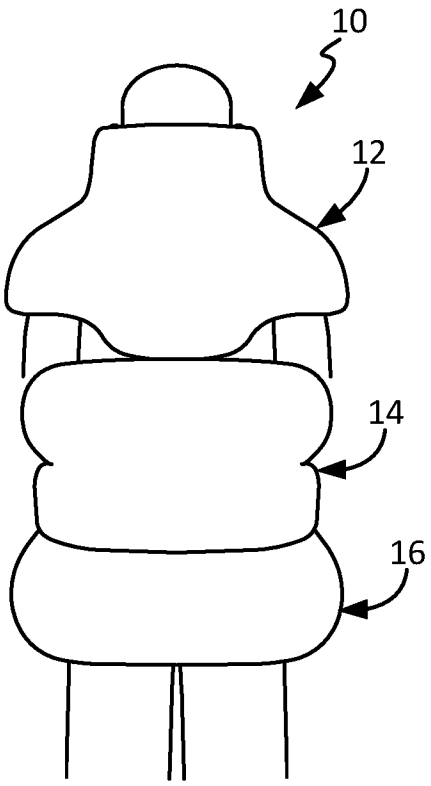
Figure 4A:
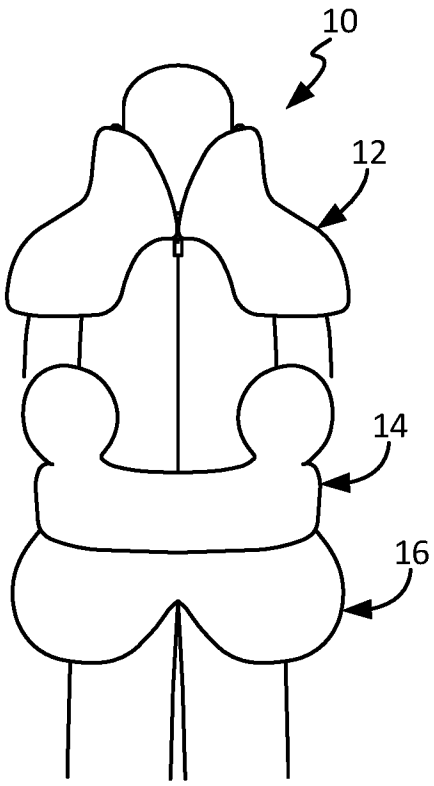

FIGS. 4A-4C show garment 10 in a fully-inflated state, without outer shell 22. Portions 12, 14, and 16 extend anteriorly, posteriorly, and bilaterally to protect the wearer from the resultant injuries of the falls depicted in FIGS. 1A-1K, as well as other types of falls not depicted. As can be seen in FIG. 4C, middle portion 14 has a donut-like shape and extends farther from the wearer's body in the anterior direction than do the other portions 12 and 16. This feature operates to prevent axial impact injuries to the wearer's wrist or arms that can occur when instinctively reaching out to break a fall (FIGS. 1C, 1D). Upper portion 12, when inflated, secures the wearer's shoulders to prevent full extension of the arm. Therefore, middle portion 14 need only extend outward a length greater than the wearer's forearms and wrist, as shown in FIG. 4C. In other embodiments, however, middle portion 14 can be configured to have other dimensions, based on the needs of the wearer.

In the embodiment shown, middle portion 14 includes a belt or fanny-pack type device that can be fixedly attached to garment 10 at one or more locations, such as sewn into the back or side of outer shell 22. Middle portion 14 can include a fastener, such as a buckle, clip, or other suitable fastener, configured to secure middle portion 14 around the wearer's midsection. When unfastened, middle portion 14 can hang from the back or sides of garment 10. In another embodiment, middle portion 14 can be completely attached to garment 10. In yet another embodiment, middle portion 14 can be configured such that it must be fastened in order for garment 10 to be activated.

Figure 5:
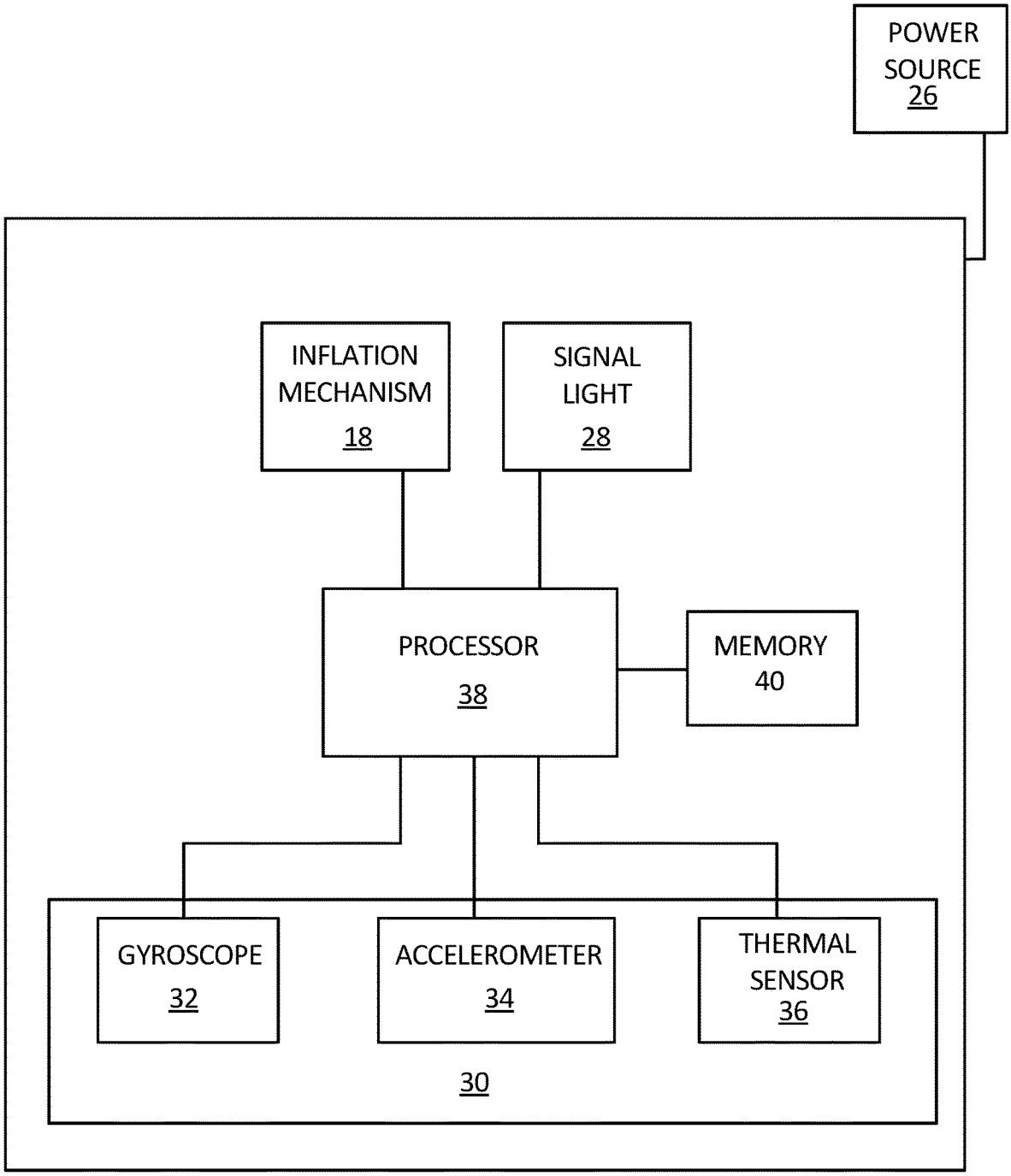
FIG. 5 is a block diagram showing the functional components of the device according to an embodiment of the present invention.

FIG. 5 is a block diagram of the functional components of garment 10. FIG. 5 shows inflation mechanism 18, signal light 28, and sensor network 30 (including gyroscope 32, accelerometer 34, and thermal sensor 36). FIG. 5 also shows processor 38 and memory 40.

Gyroscope 32 detects changes in the wearer's "uprightness." Accelerometer 34 detects accelerated downward movement, and differentiates between controlled, downward movement, and a fall. Accelerometer 34 can be configured to detect a threshold values of acceleration over a sustained time period. These threshold values can be, for example, falling at a rate of 9.8 $m/s^2$ for 5 ms or more. In other embodiments, other values can be selected. Thermal sensor 36 detects changes in physiological temperature (the wearer's body temperature, usually between 36.5-37.5° C.). In other embodiments, thermal sensor 36 can be configured to detect some other threshold temperature.

The various sensors of sensor network 30 communicate with processor 38. Processor 38 can be a microcontroller, an application specific integrated circuit (ASIC), a programmable logic device, or some other appropriate logic circuitry. Processor 38 is configured to control signal light 28, as well as deploy inflation mechanism 18 based on information received from sensor network 30. Memory 40 is any suitable storage device, and can be configured to store data temporarily or permanently, and to store instructions executed by processor 38. In some embodiments, garment 10 does not include memory 40.

Figure 6:
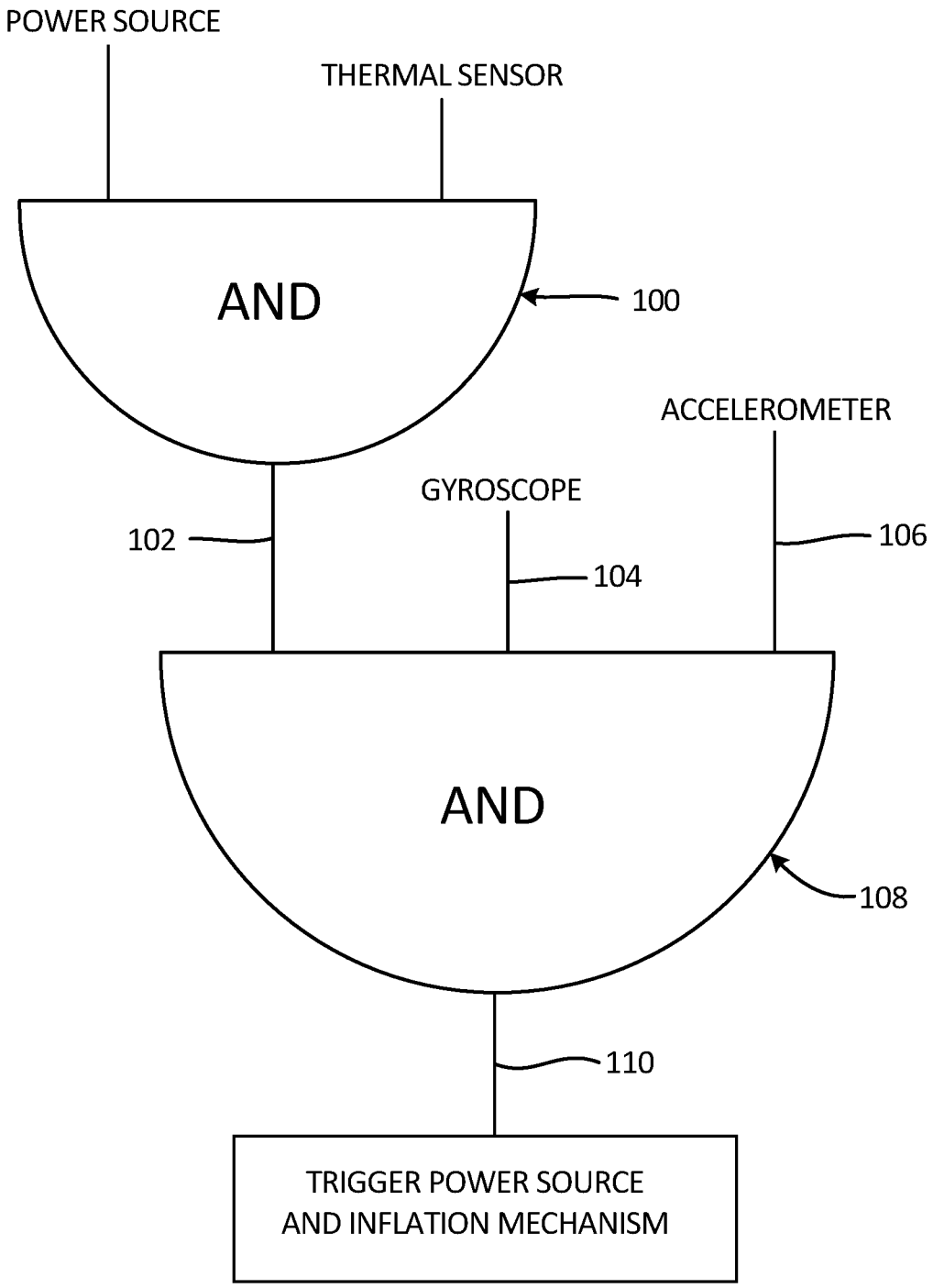
FIG. 6 is a flowchart illustrating a method of operating the device according to an embodiment of the present invention.

In operation, garment 10 is controlled by a logic circuit that allows it to process and respond to predetermined parameters. In the embodiment shown, processor 38 and memory 40 act as the logic circuit. In other embodiments, the logic circuit can be a separate hardware component of garment 10. Each of the sensors of sensor network 30—gyroscope 32, accelerometer 34, and thermal sensor 36—are in series with an AND gate and a short circuit. The logic circuit performs logical operations on the inputs received from sensor network 30, which controls the operative status of garment 10, as shown in FIG. 6.

The activation of garment 10 is controlled by the logic circuit. First, power source 26 must be charged and/or connected to garment 10 so that it achieves a powered (inactive) status (white LED light). The wearer then puts on garment 10, and thermal sensor 36 detects the change in temperature via a voltage change. This causes the AND gate 100 to have output 102 set to HIGH. Garment 10 is now active and deployable (green LED light). In some embodiments, fastening of middle portion 14 can also be required for garment 10 to be active and deployable.

The deployment of garment 10 (in the active state) is also controlled by the logic circuit. First, the wearer begins to fall. Gyroscope 32 registers a change in direction via a voltage pin (not shown), through input 104. Meanwhile, accelerometer 34 detects changes in the wearer's acceleration and registers the change through input 106. If both the wearer's motion, as measured by gyroscope 32, and acceleration, as measured by accelerometer 34, exceed predetermined threshold values, AND gate 108 has output 110 set to HIGH. An AND gate when writing HIGH completes a short in the circuit, causing power source 26 to drain. The power drain triggers inflation mechanism 18 and the inflatable chamber inflates before the wearer strikes a contact surface (the ground, a wall, a fixture, furniture, etc.).

The logic circuit is configured to prevent a misfiring, or accidental deployment, of garment 10, because the inputs of all three sensors (gyroscope 32, accelerometer 34, and thermal sensor 36) must be HIGH, or garment 10 will not deploy. For example, if the wearer removes garment 10 and tosses it onto a chair or into the laundry basket, gyroscope 32 and accelerometer 34 may detect a falling motion. However, thermal sensor 36 will not detect the threshold temperature required for the AND gate to set the output to HIGH, so the device will not deploy. Similarly, if the wearer sits or bends over while wearing garment 10, accelerometer 34 will not detect the threshold time period required to complete the AND gate logic, and garment 10 will not deploy.

After the initial deployment, garment 10 deflates as the wearer strikes the surface of the inflatable chamber. Therefore, in addition to protecting the wearer from the initial impact, garment 10 is uniquely suited to prevent or reduce a contrecoup injury due to its immediate deflation. Contrecoup injuries are most often associated with head injuries. The inflated chamber(s) can minimize the contusion of the posterior part of the wearer's brain, but if the head rebounds forward due to the inflated chamber, a severe injury to the frontal part of the brain can occur. This secondary impact is known as a contrecoup injury, and these injuries can be just as serious as those sustained during the initial impact with the contact surface.

The extent of the inflation of the inflatable chamber(s) of garment 10 can be controlled by the amount of sodium azide added to inflation mechanism 18, as well as the volume of the inflatable chamber. That is to say, the pressure of the resultant nitrogen gas on the inflatable chamber is controlled by the grams of sodium azide used in the reaction, the temperature of the nitrogen gas, and the volume of the inflatable chamber (the ideal gas law). It can be important to control the pressure of the nitrogen gas on the inflatable chamber in order to provide appropriate cushioning for a variety of individuals, and numerous falling positions.

Deflation of the inflatable chamber occurs through diffusion. When the inflation mechanism is triggered, the decomposition of sodium azide rapidly produces nitrogen gas, which fills the inflatable chamber(s) as the wearer is falling. Given the finite volume of the inflatable chamber, the pressure of the nitrogen gas builds, and it diffuses through the nylon material. Nylon has a relatively low elastic modulus—a measure of a substance's resistance to being elastically deformed when a force is exerted on it. The nylon material will deform, but not yield, as the pressure of nitrogen gas builds within the inflatable chamber. This forces the nitrogen gas to diffuse through the nylon material. This diffusion and resulting deflation also prevents contrecoup injuries, as the force of the wearer's fall is at least partially dissipated by the deflation, instead of simply resulting in an equal and opposite reaction of force on the wearer.

Garment 10 has many benefits. It can help prevent or reduce injuries sustained from various types of falls. Garment 10 is also highly customizable based on individual needs. For example, different sizes can be available and matched to the wearer. Each candidate for use of the device can be analyzed with the device in place to establish a baseline of activities of daily living to program the sensor to help customize setpoints for when garment 10 should deploy. This allows for adjustments based on use of a cane, walker or crutches. Although garment 10 is shown as a vest-like garment, it can also be a jacket or some other suitable garment.

Garment 10 can include a "sleep" mode, such that the device turns off when a wearer is sleeping and can be activated (automatically) when patient sits up and prepares to stand. Garment 10 can optionally include an alarm triggered by inflation of the vest that notifies caregivers that the wearer has fallen—an especially useful feature for a nursing home or hospital setting.

Garment 10 has other uses, beyond fall injury mitigation for people walking. For instance, the device could be used outdoors, it could be designed for use in automobiles, or as a flotation device. Other possible uses might serve the bicyclist, the motorcyclist or the home repairperson.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the spirit and scope of the entire disclosure, including the figures.

The invention claimed is:

1. An inflatable garment comprising:

an upper portion;

a middle portion;

a lower portion;

at least one inflatable chamber fluidly connected to and at least partially disposed within at least one of the upper, middle, and lower portions;

an inflation mechanism in fluid communication with the at least one inflatable chamber;

a sensor network configured to detect a plurality of physical parameters indicative of a fall; and a logic circuit configured to process the plurality of physical parameters, wherein the logic circuit is further configured to trigger the inflation mechanism when each of the plurality of physical parameters surpasses a threshold value;

wherein each of the upper, middle, and lower portions are configured to inflate in an anterior, posterior, and lateral direction via the at least one inflatable chamber;

wherein the middle portion is configured to inflate a first length from the wearer's torso in the posterior direction;

wherein the middle portion is further configured to inflate a second length from the wearer's torso in the anterior direction, the second length being greater than the first length;

wherein at least one of the upper and lower portions is configured to inflate a third length from the wearer's torso in at least one of the anterior, posterior, and lateral directions, the third length being less than the second length; and wherein the upper portion is configured to extend over the wearer's neck, shoulders, and upper arms, and immobilize the wearer's arms in an inflated state, such that in the inflated state, the upper portion secures the wearer's shoulders such that the wearer's upper arms extend downward toward the middle portion and are held against the wearer's torso.

2. The inflatable garment of claim 1, further comprising: an outer shell portion configured to secure the inflatable garment to the wearer.

3. The inflatable garment of claim 1, further comprising: a status light for signaling a status of the inflatable garment.

4. The inflatable garment of claim 3, wherein the status of the inflatable garment includes: active, inactive, and low power.

5. The inflatable garment of claim 1, further comprising: an alarm configured to notify a third party of the fall.

6. The inflatable garment of claim 1, wherein the inflation mechanism comprises a sodium azide chemical reaction.

7. The inflatable garment of claim 1, wherein the sensor network comprises:

a gyroscope, an accelerometer, and a thermal sensor.

8. The inflatable garment of claim 1, wherein the logic circuit is a processor.

9. The inflatable garment of claim 1, wherein the middle portion is configured to detach from the inflatable garment.

10. The inflatable garment of claim 1, wherein the middle portion is configured to activate the inflatable garment when fastened.

11. The inflatable garment of claim 1, wherein the lower portion is configured to surround the wearer's pelvic region.

12. The inflatable garment of claim 1, wherein the at least one inflatable chamber comprises nylon.

13. The inflatable garment of claim 1, wherein the at least one inflatable chamber comprises a plurality of inflatable chambers.

14. A method of operating an inflatable garment to protect a wearer from an impact, the method comprising:

providing the inflatable garment of claim 1 comprising at least one inflatable chamber;

configuring the inflation mechanism to be in fluid communication with the at least one inflatable chamber;

sensing, using the sensor network, a plurality of physical parameters indicative of a fall;

processing, using the logic circuit, the plurality of physical parameters;

triggering, using the logic circuit, the inflation mechanism when each of the plurality of physical parameters surpasses a threshold value;

inflating the at least one inflatable chamber using the inflation mechanism; and deflating the at least one inflatable chamber as the wearer's body strikes the at least one inflatable chamber.

15. The method of claim 14, wherein the plurality of physical parameters includes motion, acceleration, and temperature.

16. The method of claim 14, wherein the logic circuit is further configured to deactivate the inflatable garment when the plurality of physical parameters falls below a minimum threshold.

17. The method of claim 14, further comprising: signaling a status of the inflatable garment using a signal light.

18. The method of claim 14, wherein deflating the inflatable garment comprises a diffusion process through the at least one inflatable chamber.

* * * * *